US006270337B1

(12) United States Patent
Etemad et al.

(10) Patent No.: US 6,270,337 B1
(45) Date of Patent: Aug. 7, 2001

(54) DRY, LOW NOX PILOT

(75) Inventors: Shahrokh Etemad, Trumbull; Hasan Ul Karim, Hamden; William C. Pfefferle, Madison, all of CT (US)

(73) Assignee: Precision Combustion, Inc., New Haven, CT (US)

( * ) Notice: Subject to any disclaimer, the term of this patent is extended or adjusted under 35 U.S.C. 154(b) by 0 days.

(21) Appl. No.: 09/097,176

(22) Filed: Jun. 12, 1998

(51) Int. Cl.[7] ..... F23D 3/40; F02C 7/08

(52) U.S. Cl. ..... 431/7; 431/9; 431/116; 431/170; 431/328; 431/11; 431/247; 60/738; 60/750

(58) Field of Search ..... 431/7, 9, 11, 115, 431/116, 247, 248, 268, 170, 326, 8, 349, 328; 60/736, 738, 737, 749, 750; 48/189.2, 189.4, 189.5

(56) References Cited

U.S. PATENT DOCUMENTS 3,030,773 * 4/1962 Johnson ..... 431/9
3,417,978 * 12/1968 Suzukawa et al. ..... 431/7
3,430,443 * 3/1969 Richardson ..... 60/738
4,160,640 * 7/1979 Maev et al. ..... 431/9
4,262,482 * 4/1981 Roffe et al. ..... 431/247
4,374,466 * 2/1983 Sotheran ..... 60/738
4,629,413 * 12/1986 Michelson et al. ..... 431/116
4,643,667 * 2/1987 Fleming ..... 431/7
5,346,389 * 9/1994 Retallick et al. ..... 431/7
5,624,252 * 4/1997 Charles, Sr. et al. ..... 431/7
5,634,784 * 6/1997 Pfefferle et al. ..... 431/7

* cited by examiner

*Primary Examiner*—Ira S. Lazarus
*Assistant Examiner*—Josiah C. Cocks
(74) *Attorney, Agent, or Firm*—McCormick, Paulding & Huber LLP

(57) ABSTRACT

This invention relates to an apparatus and method for increasing the reactivity of a fuel/air mixture prior to homogenous combustion of the mixture. More specifically, this invention is a pilot for a gas turbine combustor which utilizes the heat of combustion within the pilot to increase the reactivity of a portion of the fuel/air mixture utilized by the pilot.

6 Claims, 1 Drawing Sheet

DRY, LOW NOX PILOT

BACKGROUND OF THE INVENTION

1. Field of the Invention

This invention relates to an apparatus and method for increasing the reactivity of a fuel/air mixture prior to homogenous combustion of the mixture. More specifically, the present invention is a pilot for a gas turbine combustor which utilizes the heat of combustion within the pilot to increase the reactivity of a portion of the fuel/air mixture utilized by the pilot.

2. Brief Description of the Related Art

Known dry low NOx combustion systems for gas turbines can achieve relatively low emissions levels; however, the use of continuous pilot systems, as distinguished from starter systems, is required to stabilize combustion over a wide range of gas turbine operational conditions and minimize emission levels.

U.S. Pat. No. 5,634,784 represents a state-of-the-art continuous pilot. The patent teaches a catalytic pilot that will make a portion of the fuel/air mixture destined for the pilot's combustion zone more reactive by passing it through a catalytic centerbody. The patent also teaches that by recirculating hot combustion gas products back on to the catalytic centerbody the catalytic centerbody can use the heat of combustion within the pilot to assure that the catalytic component of the centerbody is at a suitably high operating temperature.

The structure of the catalytic centerbody design previously taught has several shortcomings. In particular, no method is provided to limit the temperature of the centerbody, thus the surface temperature could reach the adiabatic flame temperature of the fuel/air mixture, generally above th e centerbody's material failure temperature. In addition, a catalyst is required.

It has now been found that a stabilizing pilot can be created without the use of a catalyst. By utilizing the fuel/air mixture passing through the centerbody more fully, a more versatile pilot can be created. The invention accomplishes this by increasing the channel length for the fuel/air mixture within the centerbody, and by utilizing the fuel/air mixture entering the centerbody for cooling the centerbody structure, increasing the temperature and overall combustibility of the fuel/air mixture, and allowing the centerbody to be exposed to greater temperatures, even temperatures above the material limit of the centerbody.

SUMMARY OF THE INVENTION

The Dry, Low NOx Pilot (hereinafter "pilot") is a continuously operating pilot that stabilizes the combustion within a gas turbine combustor. The basic pilot utilizes two fuel/air flows. One fuel/air flow enters a centerbody, and by passing through the centerbody obtains a temperature rise by extracting heat from the centerbody. The second fuel/air flow passes through a flow condition er capable of creating a recirculation zone to provide heat to the centerbody.

The centerbody and flow conditioner are parts of an integrated assembly. In the pilot of the present invention, the combustion zone is maintained downstream of the centerbody. The flow conditioner has the dual functions of contacting the second fuel/air mixture with heated fuel/air exiting the centerbody, and creating a recirculation zone such that hot combustion gases, either through radiation or conduction, impart a temperature rise to the centerbody. The flow conditioner can be any structure capable of accomplishing these functions, such as a swirler, a bluff body, a dump, opposed flow jets, or a combination of any of the above.

The centerbody is attached to the flow conditioner. During operation, a portion of the centerbody is simultaneously exposed to the heat of the recirculation zone on one surface and the fuel/air mixture entering the centerbody on an opposite surface (or backside). The entering fuel/air mixture sufficiently interacts with this opposite surface to obtain a temperature rise thereby lowering the temperature of the centerbody. This backside cooling of the centerbody can allow the temperature of the recirculation gases to exceed the material limit of the centerbody. Backside cooling allows for an increased temperature rise to be imparted to the fuel/air mixture; as the temperature of the recirculation gases contacting the centerbody are increased the temperature rise imparted to the fuel/air mixture is increased for any given flow.

The centerbody can be of numerous three dimensional configurations, such as cylindrical or elliptical; symmetry is not required.

The centerbody should have a high thermal conductivity. Preferably, the thermal conductivity of the cap should allow for a uniform distribution of the heat imparted to the cap from the recirculating gases so the temperature of the cap is approximately uniform.

The centerbody can incorporate a fuel/air channel. The fuel/air channel is placed within the centerbody such that the fuel/air mixture enters the space between the centerbody and the fuel/air channel, forcing the fuel/air mixture to be turned by, and to interact with, the cap. The fuel/air channel is placed within the centerbody such that a minority of the exits from the centerbody are above the exit of the fuel/air channel. The term "above" refers to a direction parallel to (and in the same direction as) the flow of the fuel/air mixture in the fuel/air channel. For the present invention structures, the centerbody is attached to the fuel/air channel by securing the base of the centerbody directly to the fuel/air channel, thereby forming a baffle and forcing all the fuel/air entering the centerbody to enter through the fuel/air channel.

For the present invention two fuel/air mixture flows are required—a fuel/air mixture flow through the flow conditioner and a fuel/air mixture flow through the centerbody. The fuel/air mixture can either be a single flow split between the flow conditioner and the centerbody based on the flow characteristics of both, or separate fuel/air flows with different characteristics. If separate fuel/air flows are provided, flow conditions could vary significantly, such as different fuel/air mixture ratios (even to the degree that one is rich and the other lean), different flow velocities, or different fuels. It is also possible to split a single fuel/air mixture but provide additional fuel injection to one or both of the two resulting fuel/air streams, thereby varying flow conditions, fuel/air mixture ratios, or fuel composition. These design alternatives can be done by those skilled in the art.

DETAILED DESCRIPTION OF THE PREFERRED EMBODIMENTS

Figure 1:
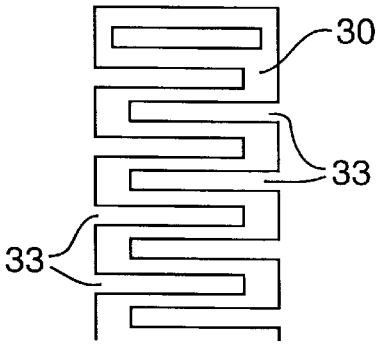
FIG. 1 is a cross-section of a centerbody.

FIG. 1 depicts a non-catalytic centerbody 30. The centerbody 30 is comprised of cylinder, open at the end where the fuel/air enters and closed at the other end, with numerous intermediate exits 33.

Figure 2:
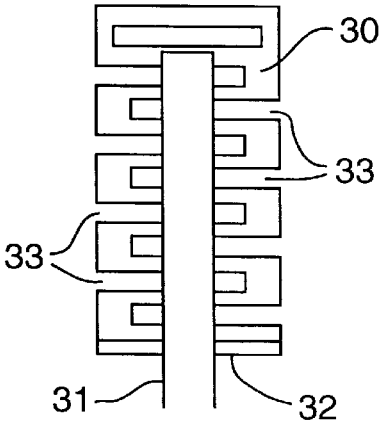
FIG. 2 is a cross-section of a centerbody incorporating a fuel/air channel.

FIG. 2 is a non-catalytic centerbody 30 as shown in FIG. 1 with a fuel/air channel 31 and baffle 32, which confines the fuel/air to entering the centerbody 30 though fuel/air channel 31. The centerbody 30 is placed approximately concentrically over the fuel/air channel 31. The sides of centerbody 30 extend to a point below the exit of fuel/air channel 20. The term "below" refers to a direction opposite the flow direction of the fuel/air mixture in the fuel/air channel 20. The fuel/air channel 31 is placed within centerbody 30 such that the exit of the fuel/air channel is below at least one exit 33. The shape of centerbody 30 is based upon the design requirements of the centerbody, and FIGS. 1 and 2 should be considered illustrative rather than limiting.

Figure 3:
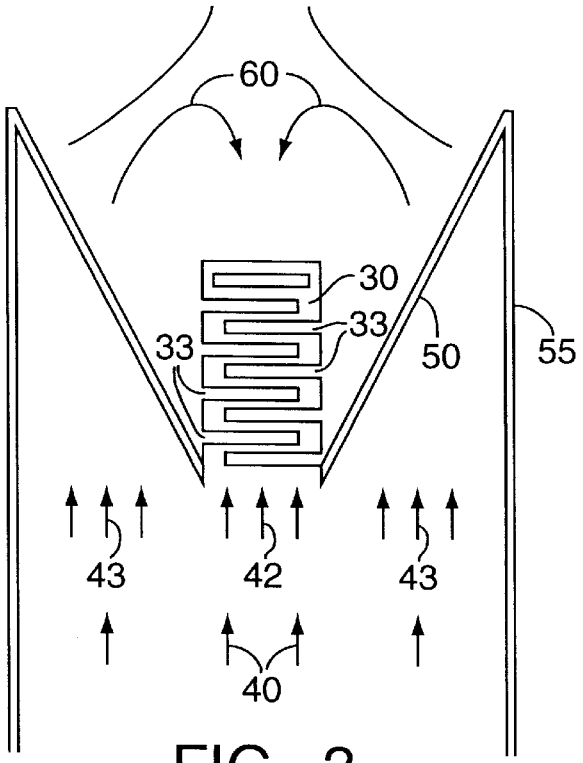
FIG. 3 is a cross-section of the pilot using a centerbody and a swirler as a flow conditioner.

FIG. 3 is a pilot employing a pilot wall 55, a centerbody 30, and a swirler 50, as the flow conditioner structure. Swirler 50 is mounted approximately concentrically within the pilot wall 55, and a centerbody 30 is mounted approximately concentrically within swirler 50. A single fuel/air mixture 40 which is forced by pressure into the swirler 50 and the centerbody 30, forming fuel/air mixtures 43 and 42 respectively.

Swirler 50 is selected such that the swirl of swirler 50 will cause a recirculation zone to form sufficient to cause the recirculating combustion gases to contact centerbody 30, throughout a significant portion of the operating range of the pilot.

To create a proper recirculation zone, swirler 50 must cause vortex breakdown within the swirl zone sufficient to cause flow reversal and backmixing. Generally, swirl number greater than 0.5 is required to achieve this result. For this invention the swirl number is defined as the quotient which results when tangential momentum flux is divided by the product of swirler radius and axial momentum flux. Tangential momentum flux is defined as the product of density, axial velocity, tangential velocity, radius, and flow area. Axial momentum flux is defined as the product of the density, the square of axial velocity, and the flow area. The combination of a dump (sudden expansion in flow area) and swirl is particularly effective in creating a strong recirculation zone, especially at low swirl number (order of magnitude 0.5). In a preferred embodiment of the present invention, a dump is located downstream of the swirler to assist in stabilizing combustion and providing strong recirculation of hot combustion gases to contact the pilot centerbody.

The placement of the centerbody 30 within swirler 50 is based on the characteristics of the recirculation zone created by swirler 50. Those skilled in the art will recognize that the strength and position of the recirculation created by swirler 50 will change over the operating range of the pilot. In the present invention, it is preferred that the recirculation created by swirler 50 be created in such a fashion that for a majority of the operating conditions of the pilot the recirculating gases 60 contact the top portion of centerbody 30, thereby causing direct conduction heating of the centerbody 30. While direct conduction heating of centerbody 30 has been described, the present invention is not limited in this regard.

As the fuel/air mixture 40 enters the pilot the fuel/air mixture flow is split naturally between the centerbody 30 and the swirler 50. The minimum fuel/air flow entering the centerbody 30 is based upon the fuel/air mixture flow required to stabilize the combustion zone and provide cooling of the centerbody 30, in the area where the centerbody is being heated by the recirculating gases 60. Those skilled in the art will appreciate that the backside cooling provided by the fuel/air mixture flow maintains the temperature of centerbody 30 at an appropriate operating temperature, based upon the materials used to construct centerbody 30. The fuel/air mixture 42 flow should be no less than approximately 1% of the total fuel/air mixture 40 flow and should not exceed approximately 25%. A preferred range is between 3% and 10%.

The required degree of interaction between the fuel/air mixture and the backside surface of the centerbody is determined by the desired temperature rise in fuel/air mixture 42; a temperature rise of the fuel/air mixture 42 is preferably at least 25 degrees Celsius. Allowable residence time is limited by either the auto-ignition delay time of the fuel/air mixture 42, or the requirement for maintaining sufficient velocity within the passage to prevent flashback of the flame. A nominal residence time is approximately 1 msec, but it could range from 0.1 to 10 msec.

Figure 4:
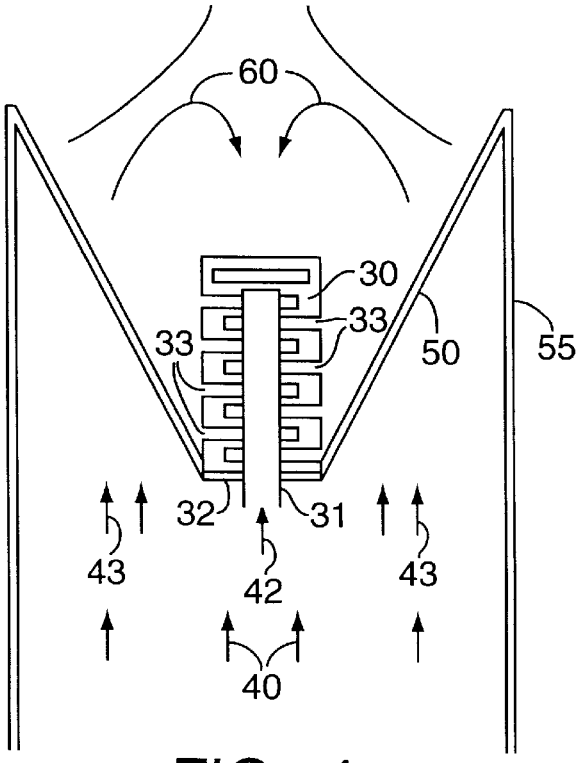
FIG. 4 is a cross-section of a pilot using a centerbody incorporating a fuel/air channel and a swirler as a flow conditioner.

FIG. 4 is a pilot employing a non-catalytic centerbody with a fuel/air channel and a swirler 50 as the flow conditioner. The use of a fuel/air channel enhances the ability of the furl/air mixture 42 to backside cool centerbody 30.

What is claimed is:

1. A method for enhancing a first fuel/air mixture so that when said first fuel/air mixture is added to a second fuel/air mixture said second fuel/air mixture will combust with greater stability, said method comprising:

generating said first fuel/air mixture, introducing said first fuel/air mixture to a non-catalytic centerbody via an entrance defined by said centerbody, expelling said first fuel/air mixture from said centerbody through a plurality of exits defined by said centerbody, and heating said centerbody using the heat of combustion of said second fuel/air mixture.

2. The method of claim 1 wherein the centerbody further comprises a fuel/air channel and baffle, said baffle attached to said fuel/air channel such that said baffle forces all said first fuel/air mixture to enter said centerbody through said fuel/air channel.

3. The method of claim 2 wherein at least one of said plurality of exits defined by said centerbody is located between the exit from said fuel/air channel and a closed end defined by said centerbody.

4. A pilot comprising:

a flow conditioner, a centerbody positioned within the flow conditioner, said centerbody being non-catalytic material, and said centerbody having an entrance and multiple exits defined by said centerbody, and a pilot wall, said flow conditioner connected to said pilot wall at one end and said centerbody at a second end.

5. The pilot of claim 4 further comprising a fuel/air channel and baffle, said baffle attached to said fuel/air channel such that said baffle forces all said first fuel/air mixture to enter said centerbody through said fuel/air channel.

6. The pilot of claim 5 wherein at least one of said multiple exits defined by said centerbody is located between the exit from said fuel/air channel and a closed end defined by said centerbody.

* * * * *